United States Patent [19]

Stahlecker

[11] 4,058,963

[45] Nov. 22, 1977

[54] OPEN-END SPINNING MACHINE WITH A PLURALITY OF SPINNING UNITS AND WITH AT LEAST ONE SERVICING DEVICE

[75] Inventor: Fritz Stahlecker, Bad Uberkingen, Germany

[73] Assignees: Fritz Stahlecker; Hans Stahlecker, Germany

[21] Appl. No.: 774,539

[22] Filed: Mar. 4, 1977

[30] Foreign Application Priority Data

Mar. 27, 1976 Germany ..... 2613180

[51] Int. Cl.[2] ..... D01H 11/00; D01H 1/12

[52] U.S. Cl. ..... 57/56; 57/58.89

[58] Field of Search ..... 57/34 R, 53–56, 57/58.89–58.95

[56] References Cited

U.S. PATENT DOCUMENTS

| | | | |
|---|---|---|---|
| 3,524,312 | 8/1970 | Landwehrkomp et al. | 57/56 |
| 3,810,352 | 5/1974 | Miyazaki et al. | 57/34 R |
| 3,884,027 | 5/1975 | Schumann et al. | 57/56 |
| 3,987,610 | 10/1976 | Stahlecker et al. | 57/58.89 X |

*Primary Examiner*—Donald Watkins

*Attorney, Agent, or Firm*—Craig & Antonelli

[57] ABSTRACT

A servicing device is provided for cleaning spinning rotors and spinning rotor housings of an open-end spinning machine. The servicing device includes a combined suction and blower device which alternately applies compressed air and suction forces to loosen and to withdraw fiber residues and the like from the spinning rotor and the housing. The servicing device is a mobile unit movable along a plurality of spinning units and includes a mechanism for opening the covers to the individual housings so as to expose the open sides of the spinning rotors to the combined suction and blowing device which is movable into position to perform cleaning operations. In order to assure control of the suction and blowing of cleaning air during cleaning operations, the cleaning device includes a suction flange which covers the housing of the spinning rotor in the manner of a lid when in the servicing position.

21 Claims, 8 Drawing Figures

FIG.5
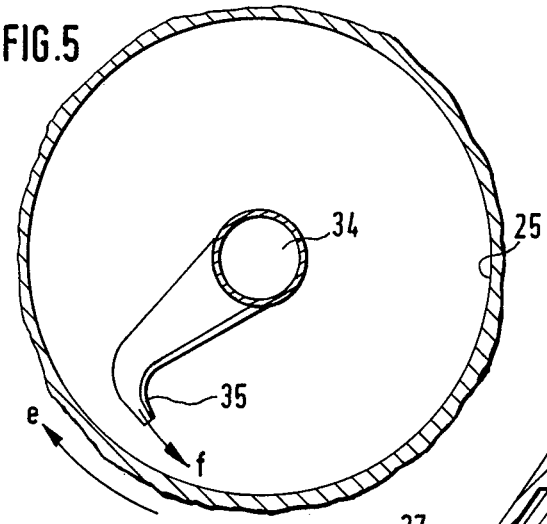
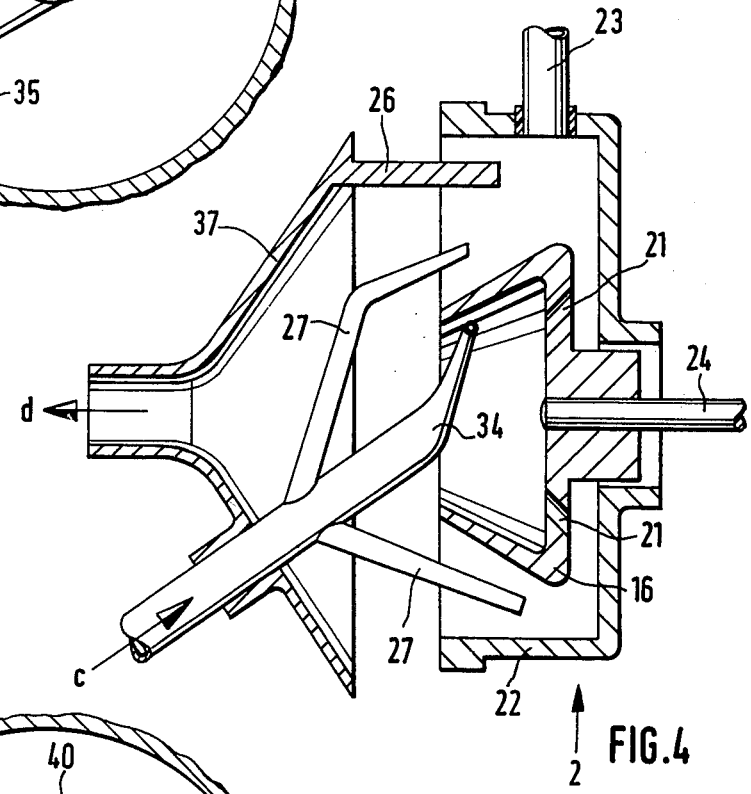
FIG.4
FIG.6
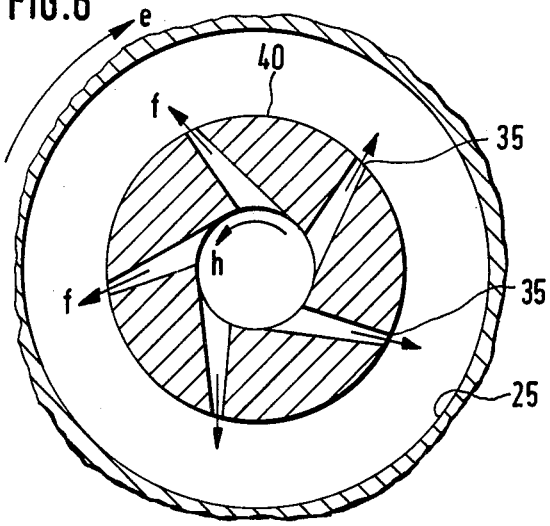

OPEN-END SPINNING MACHINE WITH A PLURALITY OF SPINNING UNITS AND WITH AT LEAST ONE SERVICING DEVICE

BACKGROUND AND SUMMARY OF THE INVENTION

The invention relates to an open-end spinning machine with a plurality of spinning units and with at least one servicing device which can be associated with the individual spinning units, this servicing device being equipped with means for uncovering a spinning rotor disposed in a housing and with means for cleaning this spinning rotor, wherein the means for cleaning comprise a combined blower and suction device movable toward the spinning rotor, this device blowing compressed air into the spinning rotor and removing fiber residues and the like from the spinning rotor.

Even though the fiber material is cleaned by special measures on its way between the feed point and the spinning rotor of an open-end spinning unit, it is unavoidable that impurities pass into the spinning rotor which lead to soiling during the course of time. Such contaminations are the cause for an impairment of the quality of the thus-produced yarns with the passage of time. In particular, there is the danger of periodically occurring flaws in the yarn which in the hosiery product or fabric manufactured therefrom manifest themselves even more unpleasantly than in case of a ring yarn. Therefore, it is necessary under practical conditions to clean the open-end spinning rotor from time to time.

In a conventional type of construction (DOS 1,760,560) the spinning rotors are cleaned when the spinning operation has been interrupted due to a disturbance. The cleaning step is to be performed with the spinning unit in the closed condition, by slowing down or arresting the spinning rotor, so that the centrifugal forces effective on the fibers and on the impurities of the spinning rotor are reduced to such an extent that the fibers and impurities can be removed by suction via a vacuum connection joined to a housing surrounding the spinning rotor. In this procedure, the vacuum which is required anyway for normal operation is utilized, which takes care during operation of transporting the fibers to the spinning rotors. In this type of structure, difficulties are encountered with respect to adapting the vacuum both for cleaning purposes and for the operating condition. For the latter, a relatively minor vacuum is sufficient, by means of which the fibers are transported to a sliding surface of the spinning rotors. Too high a vacuum during operation is disadvantageous, since then the danger is encountered that fibers are entrained by the air flowing out of the spinning rotors which represents a loss. However, on the other hand, a relatively minor vacuum is incapable of performing an adequate cleaning action since, in part, the dirt particles adhere to the spinning rotors. Even a very high vacuum is insufficient in many cases.

In another conventional type of construction (DOS 1,560,301), pneumatic or mechanical cleaning means are introduced, with the spinning unit being closed, into the spinning rotor via an additional cleaning duct. In order to remove the dirt particles detached by this cleaning means, the speed of the spinning rotor is reduced during the cleaning step so that the suction draft necessary for the operation can then remove the dirt particles. This type of structure likewise exhibits the aforementioned disadvantages regarding the dimensioning of the vacuum. Additionally, the expense for this type of apparatus is relatively high since the cleaning means must be provided at each spinning unit. Besides, there is furthermore the danger that secondary air enters via the cleaning ducts provided for the cleaning means, interferring with the spinning operation.

In another known type of apparatus (DOS 2,008,142), the spinning rotors are cleaned by a servicing device moving along the open-end spinning machine and cleaning, in case of a thread breakage, the respective spinning rotor before the piecing step is conducted, for the purpose of removing so-called residual fibers therefrom. To this end, the servicing device is equipped with means which uncover the spinning rotor to be cleaned so that a combined blower and suction device can be applied to the rotor which enters the latter. The combined blower and suction device consists of a twin tube blowing compressed air via the outer ring into the spinning rotor; this compressed air is to be exhausted via the central tube together with the detached impurities. The twin tube penetrates into the spinning rotor. In this type of construction, the vacuum necessary for the conveyance of the fibers to the spinning rotor is produced by the spinning rotor proper which, for this purpose, is provided with ventilating bores. There is no vacuum connection arranged at the housing, so that a suction removal of the impurities by way of vacuum connections present at each spinning station is impossible.

The invention is based on the problem of providing an open-end spinning machine of the type mentioned in the foregoing wherein a perfect cleaning operation is made possible without interference in the spinning procedure. The invention resides, at least in part, in that the suction portion of the combined blower and suction device comprises a flange which, during cleaning, contacts in the manner of a lid the housing surrounding the spinning rotor and is connected to a vacuum source, and connects the housing to the suction portion.

Since the suction removal of the fibers and impurities is taken over by the servicing device, the vacuum necessary for the operating condition can be designed exactly for the tasks to be accomplished thereby, without there being the danger that due to increased vacuum fibers are sucked out of the spinning rotor in the operating condition, and this results in a marked reduction in fiber losses and also decreases the danger of contamination by fly. The invention starts with the realization that, in spite of the vacuum connections present at each spinning unit, it is more expedient to equip the servicing device with a suction removal possibility since in such a case the cleaning step can likewise be controlled more satisfactorily. In this connection, the present invention attains the advantage that the spinning rotor is freed from fiber residues and impurities not only on its inside but also on its outside so that any fibers adhering perhaps in vent bores or the like are also safely removed as well. In this construction, it is furthermore unnecessary to decelerate the spinning rotor for the cleaning step, thus avoiding any wear and tear phenomena at any of the parts of the spinning unit during the conductance of the cleaning operation.

In a further development of the invention, the provision is made to equip the combined blower and suction device with a cover element which, when associated with the spinning rotor to be cleaned, is placed in front of an opening of the housing, by way of which the housing is connected to the vacuum source for spinning operations. Thereby, the advantage is obtained that even during cleaning, fibers cannot enter the conduit which takes care of the vacuum required for the operation. Besides, there is the advantage that the preferably substantially higher vacuum during the cleaning step cannot exert any influence on the vacuum of the adjacent spinning units which are still in operation.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 4 is a view similar to FIG. 3, however showing another embodiment of the invention; and FIGS. 5, 6, 7 and 8 are enlarged schematic views which show details of several other embodiments according to the invention.

DETAILED DESCRIPTION OF THE DRAWINGS

Figure 1:
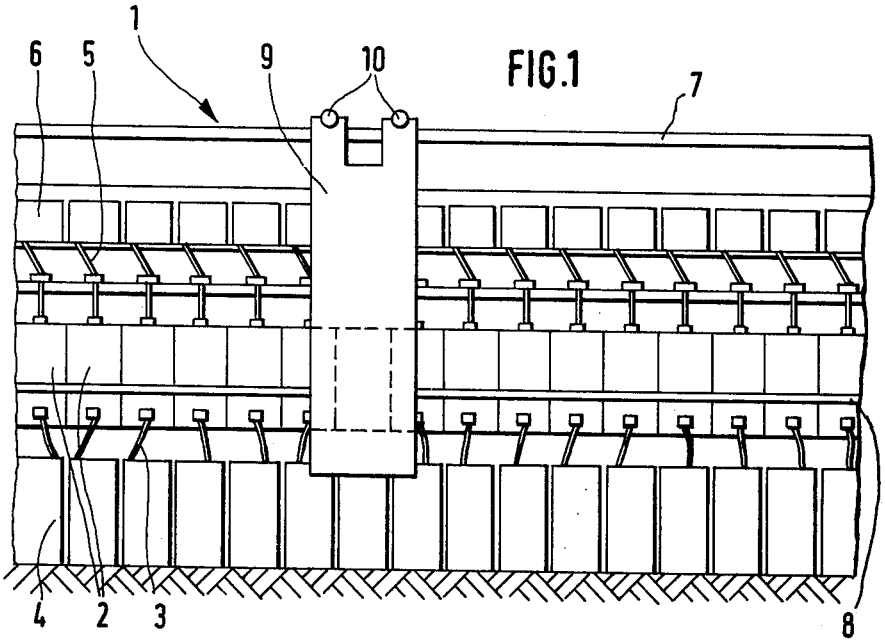
FIG. 1 is a front schematic view of a part of an open-end spinning machine with a servicing device constructed in accordance with the present invention.

The open-end spinning machine 1 illustrated in FIG. 1 comprises a plurality of spinning units 2 disposed side-by-side and each spinning a thread 5 from a sliver 3 fed from cans 4. This thread 5 is wound up by a winding bobbin *t* at each unit. Two tracks 7 and 8 extend along the open-end spinning machine 1 for a servicing device 9 movably arranged on the tracks and supported in the vertical direction on the upper track 7 by means of rollers 10, at least one of these rollers being driven. The mobile servicing device 9 is associated as required with the individual spinning units 2 and then executes servicing operations at such a location.

Figure 2:
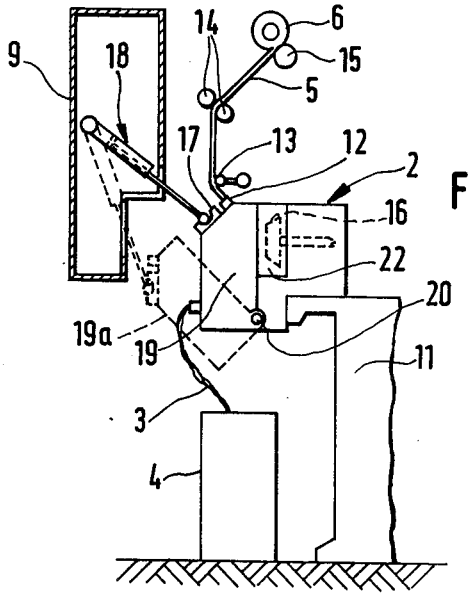
FIG. 2 is a sectional schematic view through the open-end spinning machine of FIG. 1 in the zone of the mobile servicing device.

The servicing device 9, which is illustrated only schematically in FIG. 2 without its casters 10 and additional supporting elements, contains, exclusively or additionally to other systems which likewise carry out servicing operations, means for cleaning the spinning units and particularly for cleaning spinning rotors 16 accommodated within the respective spinning units 2.

As seen in FIG. 2, the sliver 3 is fed to the spinning unit 2 from the can 4. This spinning unit 2 comprises a housing section 19 which can be swung out of the way and which contains feeding and opening members for the sliver. The opened fibers are fed to the spinning rotor 16 rotating within a housing 22. The housing 22 is part of a component which also comprises a rotor bearing, not shown, and which is attached to a machine frame 11. From the rotor 16, the thusproduced thread is taken off by way of a thread take-off duct 12 projecting from the housing section 19. This take-off operation proceeds past a thread-monitoring sensor 13 with the aid of a pair of take-off rolls 14, from where the thread passes on to the winding bobbin 6 driven by a friction roller 15.

The housing section 19, attached to the component containing the housing 22 so that it is pivotable about the axle 20, closes the housing 22 surrounding the spinning rotor 16 on the open side of the rotor, i.e. on the side where the fiber is fed and where the thread is taken off. For the reasons already explained above, namely to avoid disturbances in the operation, it is necessary to clean the spinning rotor 16 at certain time intervals or at least after a thread break has occurred. In order to make the spinning rotor 16 accessible to a cleaning tool, the housing section 19 is swung away about the axle 20 so that the spinning rotor 16 is uncovered and becomes accessible to a cleaning tool. For this purpose, the servicing device 9, which is indicated merely schematically in FIG. 2, is equipped with an operating element 18, for example with a hydraulic or pneumatic cylinder unit which is mounted to be pivotable and which engages with its free end in a spherical guide 17 of the housing section 19 to open same if required and then to close same again. The feeding and opening devices accommodated in the partial housing 19 can participate in this pivoting operation. However, it is also sufficient to merely move an area of the partial housing 19 closing off the spinning rotor 16 away from the housing 22, in order to make the spinning rotor 16 accessible.

Figure 3:
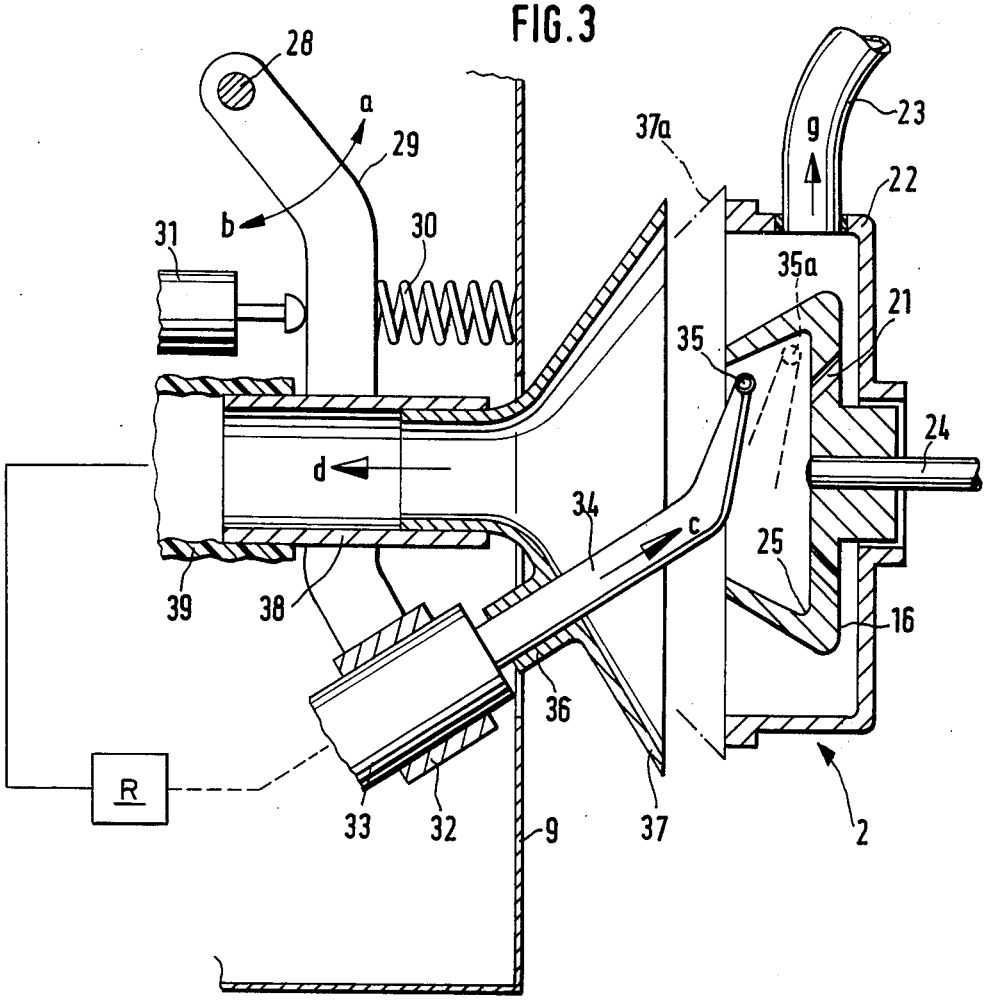
FIG. 3 is an enlarged schematic view which shows a detail of the mobile servicing device of FIG. 1 on an enlarged scale.

As shown in FIG. 3 on an enlarged scale, the spinning rotor 16 is encompassed by a housing 22 having a square or rectangular or also cylindrical configuration. The housing 22 is open toward the same side toward which the spinning rotor 16 is likewise uncovered. A vacuum conduit 23 is connected to the housing 22, by way of which a vacuum is maintained within the housing 22 during the normal spinning operation, thereby sucking the fibers into the spinning rotor 16, the latter being provided with a collecting groove 25. This vacuum is supported by ventilating bores 21 arranged in the bottom of the spinning rotor so that they extend obliquely to the axis of rotation of the spinning rotor 16. The spinning rotor 16 is disposed on a shaft 24 penetrating the rear wall of the housing 22 and being supported outside of the housing 22 in a manner not shown in detail.

Once the partial housing 19 is moved out of the way and the spinning rotor 16 has been uncovered, a combined blower and suction device can be associated therewith for cleaning purposes, as shown, in part, in FIG. 3, this combined device being part of the mobile servicing device 9. This combined blower and suction device is adaptably movable with the aid of an arm 29 pivotable about an axle 28 in the direction of the double arrow *a–b*. The adapting motion is triggered by a control element 31 which in the preferred embodiment shown is an electromagnet. The return movement is executed by way of a compression spring 30 against which the control element 31 operates. One end of arm 29 is fashioned as a holding member 32 for a blower portion 33 of the combined blower and suction device. This blower portion 33 is connected in a manner not illustrated in detail to a compressed-air source of the servicing device 9, and comprises at least one nozzle 34, the orifice 35 which can be brought into the zone of the fiber collecting groove 25 by pivoting the arm 29 (position 35*a*). From this nozzle 34, compressed air is ejected in the direction of arrow *c*.

The pivot arm 29 also carries, with a tubular holding member 38, the suction part of the combined blower and suction device. This suction part consists essentially of a flange 37 tapering in the manner of a funnel toward the holder 38. This flange 37 is connected via the tubular holder 38 to a vacuum line 39 leading to a vacuum source of the servicing device, not shown. As illustrated in FIG. 3, the nozzle 34 penetrates the funnel-like flange 37 in a spout 36 taking care of a seal toward the outside. The flange 37 is associated with the spinning unit 2 by the arm 29 so that the flange 37 contacts with its rim the open rim of the housing 22 (position 37*a*) and seals the latter in the manner of a lid. To obtain satisfactory contact without having to maintain very narrow tolerances, it is advantageous to make the flange 37 of an elastic material at least in the region of its rim. The suction part exposes not only the spinning rotor but also the housing 22 to a suction draft in the direction of arrow *d*.

Since the cleaning of the spinning units 2, taking place after predetermined time intervals or also in case of a thread break or after an impairment of the thread quality has been observed, is to be effected exclusively by the mobile servicing device 9, the vacuum supplied via the vacuum conduit 23 and effective in the direction of arrow *g*, supported by the effect of the ventilating bores 21 of the spinning rotor 16, can be dimensioned so that it is sufficient for a safe transporting of the fibers without there being the danger that the fibers are removed by suction to the outside during operation over the open rim of the spinning rotor before the fibers impinge on the conically inclined rotor wall. A substantially higher vacuum can be utilized for the cleaning operation, supplied by the suction portion of the combined blower and suction device in the direction of arrow *d*. Due to this vacuum, an air current is produced effecting a suction removal not only from the interior of the spinning rotor 16 but also from the housing 22 surrounding the spinning rotor 16, so that the danger is reduced of fibers adhering in the ventilating bores 21. In this connection, it is advantageous to provide regulating elements, not shown in detail, but schematically depicted at R in FIG. 3, which take care of conducting the exhausting of compressed air via the nozzle 34 and the suction removal via the flange 37 in an alternating cycle. Since the spinning rotor 16 need not be arrested for the cleaning step, it can continue its operation even after a thread break. This has the advantage that the residual fibers still present in the spinning rotor 16 are securely held in the collecting groove by the centrifugal force before the cleaning step is executed so that even then they are not removed by suction through the vacuum conduit 23. In particular, if it is desired to perform the cleaning step while the spinning rotor continues its operation with undiminished speed, a relatively high suction draft must be expended by the vacuum portion, which is at least so strong that the centrifugal forces effective on the fibers present in the spinning rotor 16 are overcome.

To prevent with certainty a penetration of impurities into the vacuum conduit 23, the provision is made in accordance with the FIG. 4 embodiment that the vacuum conduit is covered during the cleaning step. According to FIG. 4, an extension 26 is arranged at the flange 37 for this purpose, this extension 26 being placed in front of the mouth of the vacuum conduit 23 when the flange 37 is associated with the housing 22. In this embodiment, it is also contemplated to equip the blower portion 33 with additional nozzles 27 oriented into the space between the housing 22 and the outside of the rotor. This achieves an improved cleaning of the outside of the rotor and of the housing 22, while besides an increased air flow occurs during suction through the ventilating bore 21 from the outside of the rotor to its interior so that the ventilating bores are freed even more satisfactorily of fiber residues or the like.

The cleaning effect can be improved by the fashion of arranging and/or configuring the nozzles 34 according to other embodiments. As shown schematically in FIG. 5, it is advantageous to orient the orifice 35 of the nozzle in the peripheral direction of the collecting groove 25 of the spinning rotor 16 in the direction of arrow *f*, the spinning rotor in turn being driven in the direction of arrow *e*, i.e. in the opposite direction. This makes it possible for the air jet hitting the collecting groove 25 to detach the impurities or fiber residues from the collecting groove 25.

In the embodiment of FIG. 6, the feature is illustrated of fashioning the nozzle 34 as a nozzle scroll 40 having five orifices 35 likewise having a blowing direction in correspondence with the arrows *f* oriented somewhat against the peripheral direction of the collecting groove 25 and in opposition to the direction of rotation *e*. Also, the invention contemplates embodiments with provisions to rotatably drive the nozzle 34 by elements which are not illustrated so that it rotates in opposition (direction h) to the running direction e of the spinning rotor 16.

Figure 7:
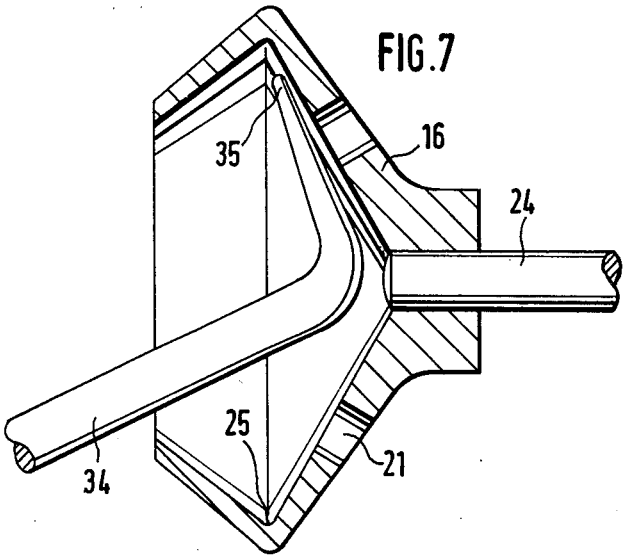

FIG. 7 shows a spinning rotor 16 provided with ventilating bores 21, the bottom of which rotor 16 has a conical inclination toward the axis of rotation. The nozzle 34, curved similarly to the embodiment of FIG. 5 against the direction of rotation in the peripheral direction of the collecting groove 25, is furthermore bent so that it penetrates deeply into the spinning rotor 16 and is bent back approximately in parallel to the bottom. Consequently, the compressed air exiting from the orifice 35 of the nozzle 34 is provided with a component in the direction toward the open side of the spinning rotor 16, so that the suction removal step is supported.

Figure 8:
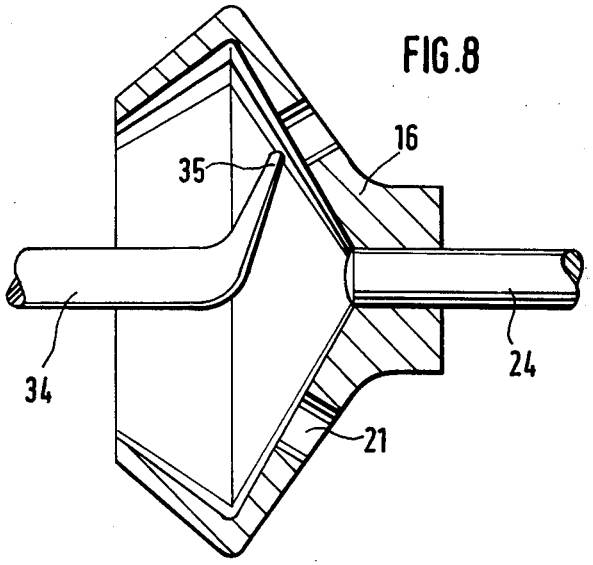

In case of a spinning rotor 16 provided with ventilating bores 21, there is the danger that precisely the ventilating bores retain impurities and are thereby clogged up in some cases. To clean specifically the ventilating bores 21, the provision is made in accordance with the embodiment of FIG. 8 to dispose the orifice 35 of the nozzle 34 so that the exiting jet of compressed air impinges on the ventilating bores 21 arranged along a circle having a predetermined diameter concentrically to the rotor axis.

Although the construction of the nozzles 34 and/or the arrangement of their orifices 35 is illustrated in FIGS. 5–8 respectively for a single nozzle, it is also contemplated by the invention that all of these nozzle configurations and arrangements can be utilized simultaneously in a cleaning device.

The flange 37 and the nozzle 34 can be supplied by units of the servicing device with the required vacuum and/or compressed air. In this connection, it is possible to carry appropriate vacuum and/or compressed air sources on the servicing device or to establish, via the servicing device, connections to coupling conduits fixedly installed in the open-end spinning machine.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. Open-end spinning apparatus including a servicng device for servicing individual spinning units of an open-end spinning machine of the type having a spinning unit with a spinning rotor disposed in a housing; said servicing device including:

a suction device, and suction device moving means for moving said suction device toward a spinning rotor to a servicing position where said suction device can remove fiber residues and the like from the spinning rotor by applying suction thereto.

wherein a suction portion of said suction device includes a flange which contacts the housing surrounding the spinning rotor in the manner of a lid when in said servicing position.

2. Apparatus according to claim 1, wherein said servicing device includes a vacuum source, wherein said suction device includes means for connecting said flange to said vacuum source such that said suction device applies a higher suction force to said spinning rotor and said housing than is applied to said housing and rotor during normal spinning operations.

3. Apparatus according to claim 1, wherein said open-end spinning machine includes a plurality of spinning units having respective housings and spinning rotors disposed therein, each of said housings having cover means for covering said spinning rotors during spinning operations, and wherein said servicing device includes means for moving said cover means to a position permitting access to said rotor by said suction device, said flange contacting the housing at the side of the housing where said cover means is disposed during spinning operations.

4. Apparatus according to claim 3, further comprising a blower device combined with and movable with said suction device to form a combined blower and suction device, said blower device including means for blowing compressed air into the spinning rotor and housing to aid in loosening fiber residues and the like.

5. Apparatus according to claim 4, wherein said servicing device includes a vacuum source, wherein said suction device includes means for connecting said flange to said vacuum source such that said suction device applies a higher suction force to said spinning rotor and said housing than is applied to said housing and rotor during normal spinning operations.

6. Apparatus according to claim 4, wherein a blower portion of the combined blower and suction device comprises at least one nozzle for ejecting an air jet into a fiber collecting groove of the spinning rotor to be cleaned.

7. Apparatus according to claim 6, wherein the at least one nozzle of the blower portion are oriented in the peripheral direction of the fiber collecting groove of the spinning rotor in opposition to the direction of rotation of the spinning rotor.

8. Apparatus according to claim 6, wherein the blowing direction of the at least one nozzle comprises a component oriented toward the suction portion of the combined blower and suction device.

9. Apparatus according to claim 7, wherein the blowing direction of the at least one nozzle comprises a component oriented toward the suction portion of the combined blower and suction device.

10. Apparatus according to claim 4, wherein the combined blower and suction device is provided with a cover member which, when the blower and suction device is in a servicing position, is placed in front of an opening of the housing by way of which the housing is connected to a vacuum source during spinning operations.

11. Apparatus according to claim 7, wherein the combined blower and suction device is provided with a cover member which, when the blower and suction device is in a servicing position, is placed in front of an opening of the housing by way of which the housing is connected to a vacuum source during spinning operations.

12. Apparatus according to claim 8, wherein the combined blower and suction device is provided with a cover member which, when the blower and suction device is in a servicing position, is placed in front of an opening of the housing by way of which the housing is connected to a vacuum source during spinning operations.

13. Apparatus according to claim 10, wherein the blower portion of the combined blower and suction device comprises at least one nozzle oriented into a space between the outside of the spinning rotor to be cleaned and the associated housing when in a servicing position.

14. Apparatus according to claim 4, wherein the blower portion comprises at least one nozzle oriented toward ventilating bores of the spinning rotor to be cleaned.

15. Apparatus according to claim 13, wherein the blower portion comprises at least one nozzle oriented toward ventilating bores of the spinning rotor to be cleaned.

16. Apparatus according to claim 4, wherein the flange of the suction portion, which flange surrounds the rim of the housing encompassing the spinning rotor to be cleaned, narrows in the manner of a funnel toward a connection for a vacuum line.

17. Apparatus according to claim 1, wherein the flange of the suction portion, which flange surrounds the rim of the housing encompassing the spinning rotor to be cleaned, narrows in the manner of a funnel toward a connection for a vacuum line.

18. Apparatus according to claim 16, wherein the funnel-like flange consists of an elastic material.

19. Apparatus according to claim 17, wherein the funnel-like flange consists of an elastic material.

20. Apparatus according to claim 18, wherein an elastically movable flap is attached to the flange of the suction portion, this flap being introducible into the housing and positionable in front of the connection of a vacuum conduit for applying vacuum to said housing during spinning operations.

21. Apparatus according to claim 4, wherein the servicing device contains switching elements for establishing the connection of the blower portion and of the suction portion of the combined blower and suction device to associated sources of compressed air and vacuum, in an alternating cycle.

* * * * *